US008863758B1

(12) United States Patent
Walenciak

(10) Patent No.: US 8,863,758 B1
(45) Date of Patent: Oct. 21, 2014

(54) REMOVABLE ADAPTIVE DEVICE FOR A CLIPPER INSTRUMENT

(71) Applicant: Nick Walenciak, Weatherford, OK (US)

(72) Inventor: Nick Walenciak, Weatherford, OK (US)

( * ) Notice: Subject to any disclaimer, the term of this patent is extended or adjusted under 35 U.S.C. 154(b) by 0 days.

(21) Appl. No.: 13/889,633

(22) Filed: May 8, 2013

Related U.S. Application Data

(60) Provisional application No. 61/688,473, filed on May 15, 2012.

(51) Int. Cl.

| | |
|---|---|
| ***A45D 29/18*** | (2006.01) |
| ***A45D 29/00*** | (2006.01) |
| ***A44C 9/00*** | (2006.01) |
| ***A44C 19/00*** | (2006.01) |
| ***B26B 13/22*** | (2006.01) |
| ***B26B 17/00*** | (2006.01) |
| ***B26B 27/00*** | (2006.01) |
| ***A45D 29/02*** | (2006.01) |

(52) U.S. Cl.
CPC ..... *A45D 29/02* (2013.01); *B26B 27/007* (2013.01)
USPC ..... 132/73.5; 132/75.5; 30/28; 30/298; 63/15

(58) Field of Classification Search
CPC ..... A45D 29/00; A45D 29/02; A45D 29/18; A45D 29/22; A44C 9/00; B26B 27/007
USPC ..... 132/73.5, 213, 214, 73, 75, 75.3, 75.4, 132/75.5, 76.5, 289, 333; 30/26, 28, 29, 30/341, 298, 232, 291; 63/1.12, 3, 15, 63/15.8; 119/600, 619; D28/52, 54, 56, D28/57, 60, 62; D11/26; 224/217, 249, 218, 224/267; 294/99.2, 25; 24/3.2; 401/8; 15/443
See application file for complete search history.

(56) References Cited

U.S. PATENT DOCUMENTS

| | | | | | |
|---|---|---|---|---|---|
| 1,269,491 | A | * | 6/1918 | Murray | 131/258 |
| 1,286,610 | A | * | 12/1918 | Harriman | 224/217 |
| 1,529,321 | A | * | 3/1925 | Pearson | 132/73.5 |
| 4,196,514 | A | * | 4/1980 | Merriman | 30/28 |
| 4,564,034 | A | * | 1/1986 | Mackel | 132/73 |
| 4,788,768 | A | * | 12/1988 | Ohori | 30/28 |
| 4,846,710 | A | * | 7/1989 | Campbell | 434/166 |
| 4,984,366 | A | * | 1/1991 | Powers | 30/124 |
| 5,046,381 | A | * | 9/1991 | Mueller | 74/558 |
| 5,384,960 | A | * | 1/1995 | Tottenham | 30/28 |
| 5,524,344 | A | * | 6/1996 | Bazal | 30/28 |
| 5,531,025 | A | | 7/1996 | Albone | 30/28 |
| 5,542,588 | A | * | 8/1996 | Sison | 224/218 |
| D384,773 | S | * | 10/1997 | Dunn | D28/60 |
| D391,026 | S | * | 2/1998 | Stubbs | D28/60 |
| 5,740,611 | A | * | 4/1998 | Schloss | 30/29.5 |
| 5,870,826 | A | * | 2/1999 | Lewan | 30/28 |
| 5,931,167 | A | * | 8/1999 | Coleman | 132/73.5 |
| 6,237,194 | B1 | * | 5/2001 | Williams | 16/430 |
| 6,560,874 | B1 | * | 5/2003 | DeMezzo | 30/28 |
| 6,895,639 | B1 | * | 5/2005 | Bayton | 16/430 |
| D636,288 | S | * | 4/2011 | Gaspard | D11/30 |

(Continued)

*Primary Examiner* — Vanitha Elgart
(74) *Attorney, Agent, or Firm* — Martin G. Ozinga; Phillips Murrah, PC

(57) ABSTRACT

Invention generally includes a ring with a slit for removably positioning clippers and an aperture for positioning a finger and wherein the ring is made from a semi elastic material that allows wedging of the clipper in the slit as well as positioning a finger in the aperture.

1 Claim, 4 Drawing Sheets

(56) References Cited

U.S. PATENT DOCUMENTS

2002/0096899 A1* 7/2002 Kang ..... 294/99.2
2008/0210724 A1* 9/2008 Geis et al. ..... 224/217
2010/0285283 A1* 11/2010 Kingsbury ..... 428/195.1
2011/0289966 A1* 12/2011 Ahrenholtz et al. ..... 63/15.6

* cited by examiner

REMOVABLE ADAPTIVE DEVICE FOR A CLIPPER INSTRUMENT

CROSS-REFERENCE TO RELATED APPLICATIONS

Priority is claimed from provisional patent application U.S. Ser. No. 61/688,473 filed on May 15, 2012, and incorporated by reference herein.

BACKGROUND OF THE INVENTION

1. Field of the Invention

In general, the present invention relates to an adaptive device for a clipper generally utilized on finger and toenails. More in particular, the present invention generally provides a removable device for use with a standard clipper that allows for selective positioning on the hand utilizing the clippers and provides a mechanical advantage as well as an easier and more accurate utilization of same.

2. Description of the Prior Art

Humans and many animals possess a flattened, elastic structure of a horny texture located on the dorsal surface of the terminal phalanges of the fingers and toes, commonly referred to as "nails". Due to the nature of nails, they are constantly growing and, therefore, the subject of constant personal grooming and trimming to be kept at a reasonable length.

Most common nail clippers comprise upper and lower mandibles, which are connected together at one end. The opposite end typically has opposed facing jaws having sharpened cutting edges. The mandibles are generally manufactured from spring steel or the like and are slightly divergent from each other from their point of connection, at one end, to the cutting edges at the other. The mandibles are apertured near the cutting edges to accept a rotatable hinge post, which is disposed generally at right angles to the cutting edges.

An operating lever is secured to the hinge post and has an upstanding cam surface formed thereon, adjacent to the hinge post. The operating lever may be elevated and rotated from a position nested adjacent the upper mandible to an inverted position in vertical alignment above the upper mandible with the cam surface rotated so as to be brought in engagement with exposed face of the upper mandible. Through pressure on the operating lever, the cam surface on the operating lever forces the upper mandible into contact with the lower mandible to thereby clip a nail positioned there between.

Nail clippers are most frequently held between the thumb and the phalange of the second row of the index finger and squeezed together to trim the anterior extremity or free edge of the nail. While they are held at a right angle to the phalange of the second row of the index finger, the divergent ends are squeezed together to bring the cutting blades against the nail from above and below.

While most adults can operate clippers in this manner, using the phalange of the second row of the index finger brings about a certain amount of instability in that neither the thumb nor the index finger holds the clippers in a fixed direction so that it tends to flop about. Some stability is achieved by temporarily pressing the jaws of the clippers against the end of the finger, adjacent the nail to be trimmed, to provide more stable, three-point positioning.

A shortcoming of this design is the difficulty of securely gripping the nail clipper so as to firmly and accurately position the clipper adjacent a nail so as to position and maintain the nail between the jaws without shearing while applying sufficient pressure on the operating lever to close the jaws to cut the nail. Where there is a sufficient size difference between the clipper and the operator's hand, or where the hand of the operator suffers an injury or illness which limits the force or accuracy which the force may be applied to the operating lever, or where the operator's hands are slippery from water, soap or toiletry products, operation of the clipper may be difficult.

It is known in the prior art to provide a loop to the clipper for positioning the clipper on a finger. These prior art devices are typically formed into the body of the clipper and are made from metal like the body of the clipper. These devices, however, do not allow for removal, are more expensive, and do not provide a relatively flexible fit for positioning on a finger. Furthermore, due to the nature of a metal loop, the fit on the finger is not adjustable which may mean the loop is too small or too large making the loop unusable depending on the person's finger size. These loops are made into the body of the clipper are not removable meaning that if the loop does not fit the user, the clipper becomes unusable by the user.

There is currently a need for an adaptive device that is easily usable as well as affordable. Currently in the prior art, there is no such device which is sufficient. The above discussion is not to be considered exhaustive, however, does demonstrate that a need exists for allowing individuals to effectively customize a clipper as desired. The consuming public is looking for solutions to address these needs and there is an obvious need to fill the gap where the prior art has failed. What is needed is an adaptive device to address these shortcomings in the prior art.

SUMMARY OF THE INVENTION

In view of the foregoing disadvantages inherent in the known types of devices for use with clipper and standard clippers in general now present in the prior art, the current invention provides a new and improved design where the prior art fails. As such, the general purpose of the present invention, which will be described subsequently in greater detail, is to provide a new and improved removable adaptive device for use with nail clippers which has all the advantages of the prior art and none of the disadvantages.

The present invention essentially provides a removable and relatively flexible finger piece that attaches to the rear end of the nail clippers to position the third row or distal phalange of the index finger therein to eliminate the conventional right angle arrangement between the axis of the thumb and index finger. Using this invention, the clippers may then be held between the ends of the thumb and index finger while they are in a substantial parallel, pincer-like position.

In one embodiment, the distal phalange of the index finger is fixedly captured in the finger piece to make the whole assembly pivotally inflexible. This provides the greatest accuracy for nail clipping. In another embodiment, the finger piece allows for an angled holding of the clipper relative to the index finger during use. This provides improved retaining of the clippers during use during a generally right angle of use.

The invention allows for the nail clippers to generally be converted from a tool held between the thumb and phalange of the second row of the index finger to one captured between the thumb and distal phalange of the index finger in a pincer-like manner to provide greatly improved stability and accuracy and to eliminate the need to balance the clippers against the end of the finger whose nail is to be clipped.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction, arrangement of the components, systems, ranges and amounts thereof set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other apparatus, compositions, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved removable adaptive device for clippers that may allow greater stability during use and improved stability during use by persons having a lesser degree of dexterity with their fingers and thumbs.

It is a further object of the present invention to provide a new and improved removable adaptive device for clippers that may also be customizable in regards to orientation of the clipper on the hand as desired.

An even further object of the present invention is to provide a new and improved removable adaptive device for clippers that is susceptible to a low cost of manufacture and implementation, and, thus accordingly, is then susceptible to low prices of sale or use to the consuming public thereby making such economically available.

Still another object of the present invention is to provide a new and improved removable adaptive device for clippers which provides all of the advantages of the prior art, while simultaneously overcoming some of the disadvantages normally associated therewith.

Another object of the present invention is to provide a new and improved removable adaptive device for clippers that may provide for the nail clippers to be converted from a tool held between the thumb and phalange of the second row of the index finger to one captured between the thumb and distal phalange of the index finger in a pincer-like manner to provide greatly improved stability and accuracy and to eliminate the need to balance the clippers against the end of the finger whose nail is to be clipped.

Yet another object of the present invention is to provide a new and improved removable adaptive device for clippers that lessen the risk of accidental injury while grooming.

It is still a further object of the present invention to provide a new and improved removable adaptive device for clippers that provides a tapered opening for a finger thus allowing the individual user to utilize the loop regardless of size or otherwise making the loop a universal fit.

These, together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices.

DETAILED DESCRIPTION

Figure 1:
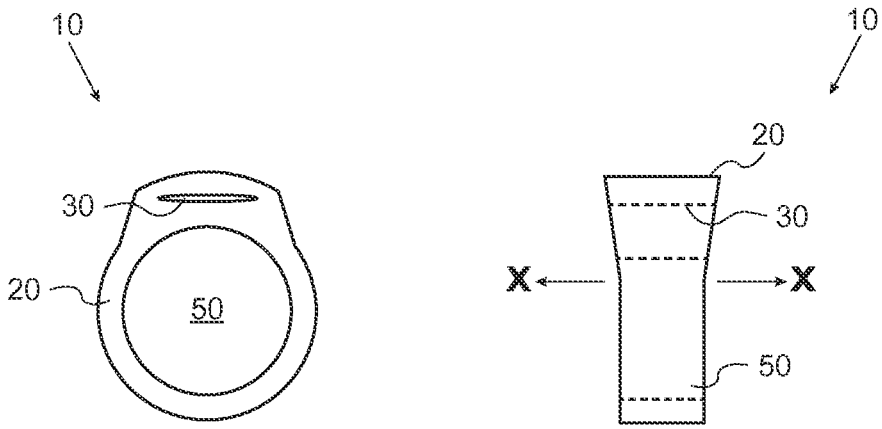
FIG. 1 is generally a front and corresponding side view of a preferred embodiment in accordance with the current invention.

Referring to the illustrations, pictures and drawings, where like elements are generally identified with like numerals throughout, in a preferred embodiment, invention 10 generally comprises removable adaptive device for clippers, system and method of making and using the same. Invention 10 generally includes a ring 20 with a slit 30 for positioning clippers 40 and an aperture 50 for positioning a finger 60. Invention 10 may be of many dimensions, shapes and sizes and the illustration should not be considered to limit the invention to just the illustrations. It is understood that although the illustrations and detailed description refer to the invention generally as a "removable adaptive device for clippers", the current invention should not be limited by the term and terms.

It is contemplated that the current invention may have numerous applications and utilities where it is desired to generally provide an adaptive device to a standard or known nail clipper. The invention is not limited to clippers and may be utilized on other types of instruments such as but not limited to other grooming devices, medical instruments, industrial tools and so forth. Furthermore, the term "ring" should not be considered to limit the invention to conventional ornamental rings or items worn like ornamental rings.

In a preferred embodiment, ring 20 is an elastomeric and may be made from a polymer, elastomer, artificial elastomer, natural or manmade rubber, and combinations thereof having a durometer of about and around 40. A preferred embodiment utilizes a durometer hardness of about 40 although more and less may also be contemplated. It is understood that a durometer is one of several measures of the hardness of a material. Hardness may be defined as a material's resistance to permanent indentation. The term durometer is often used to refer to the measurement, as well as the instrument itself. Durometer is typically used as a measure of hardness in polymers, elastomers, and rubbers. There are several scales of durometer, used for materials with different properties. The two most common scales, using slightly different measurement systems, are the ASTM D2240 type A and type D scales. The A scale is for softer plastics, while the D scale is for harder ones. However, the ASTM D2240-00 testing standard calls for a total of 12 scales, depending on the intended use; types A, B, C, D, DO, E, M, O, OO, OOO, OOO-S, and R. Each scale results in a value between 0 and 100, with higher values indicating a harder material.

It is contemplated the material is soft enough to allow a firm wedging of clippers 40 into slit 30, but not so elastic that the ring 20 deforms while in operation. Too much deformation makes the invention non-sturdy and may cause unwanted slippage. It is not desirable for the material to deform to such a degree that the force used to operate the clippers 40 causes unwanted movement while in operation. It has been found that a durometer of 60 to 70 provides a preferred embodiment to avoid such.

Referring to the illustrations, a known general type of nail clippers 40 to which this invention may be applied is depicted. Nail clippers 40 are shown to comprise an upper member 70 and a lower member 80 coextensive in length with each other, in cooperatively opposed and superimposed position, having correspondingly mated inward end portions 90 and spaced-apart outward end portions 100 wherein said outward end portions 100 are fixedly joined together at end or member junction 110 by a rivet 120 or other known means. Members 70 and 80 are yieldingly resilient and made from spring-type material such as chrome-plated or nickel silver plated stainless steel and the like.

Inward end portions 90 are spring-biased, by the original bend applied to either or both members, and spaced-apart in divergent relationship. They include transverse confronting jaws 130 with mating primary cutting blades 140 of requisite curvature and clipping ability.

A lever 150 is pivotally retained in a notch 160 formed in a stud 170 that is loosely retained in a pair of aligned apertures 180 and 190, formed in members 70 and 80 respectively, at a divergent portion of members 70 and 80, and extends angularly upward from a divergent portion of said members to a thumb rest 200 located at the distal end thereof. A cam-like surface 210 is formed on lever 150 and bears against upper member 70 for rotating with lever 150 and squeezing said members 70 and 80 and cutting blades 140 together in a clipping action when said lever 150 is angularly pivoted downward, by thumb pressure, toward member junction 110.

Ring 20 may be removably attached to said fixed end junction 110 of members 70 and 80 for housing the distal end or third row phalange of the index finger 60. Ring 20 is preferably attached to said end junction 110 on the opposite side thereof from lever 150 to allow for the maximum angular movement there between.

In a preferred construction, ring 20 is a capsular body having an aperture 50 for placing finger 60. Slit 30 is generally configured to receive fixed end junction 110 by wedging in the semi elastic material comprising ring 20. Aperture 50 may be of numerous sizes and shapes and may also be generally tapered. Slit 30 may also be of numerous sizes and shapes and may also be generally tapered.

Figure 2:
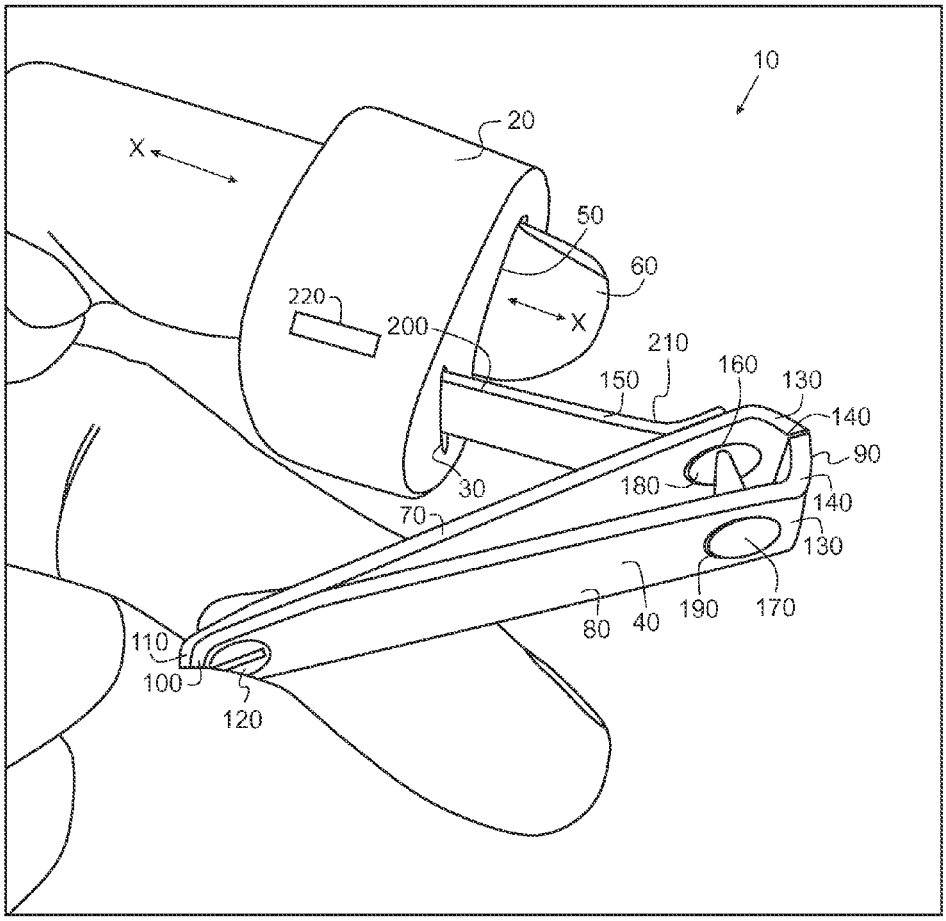
FIG. 2 is generally an illustration of a preferred embodiment in accordance with the current invention with a lever in a slit and an index finger in a ring aperture.
Figure 3:
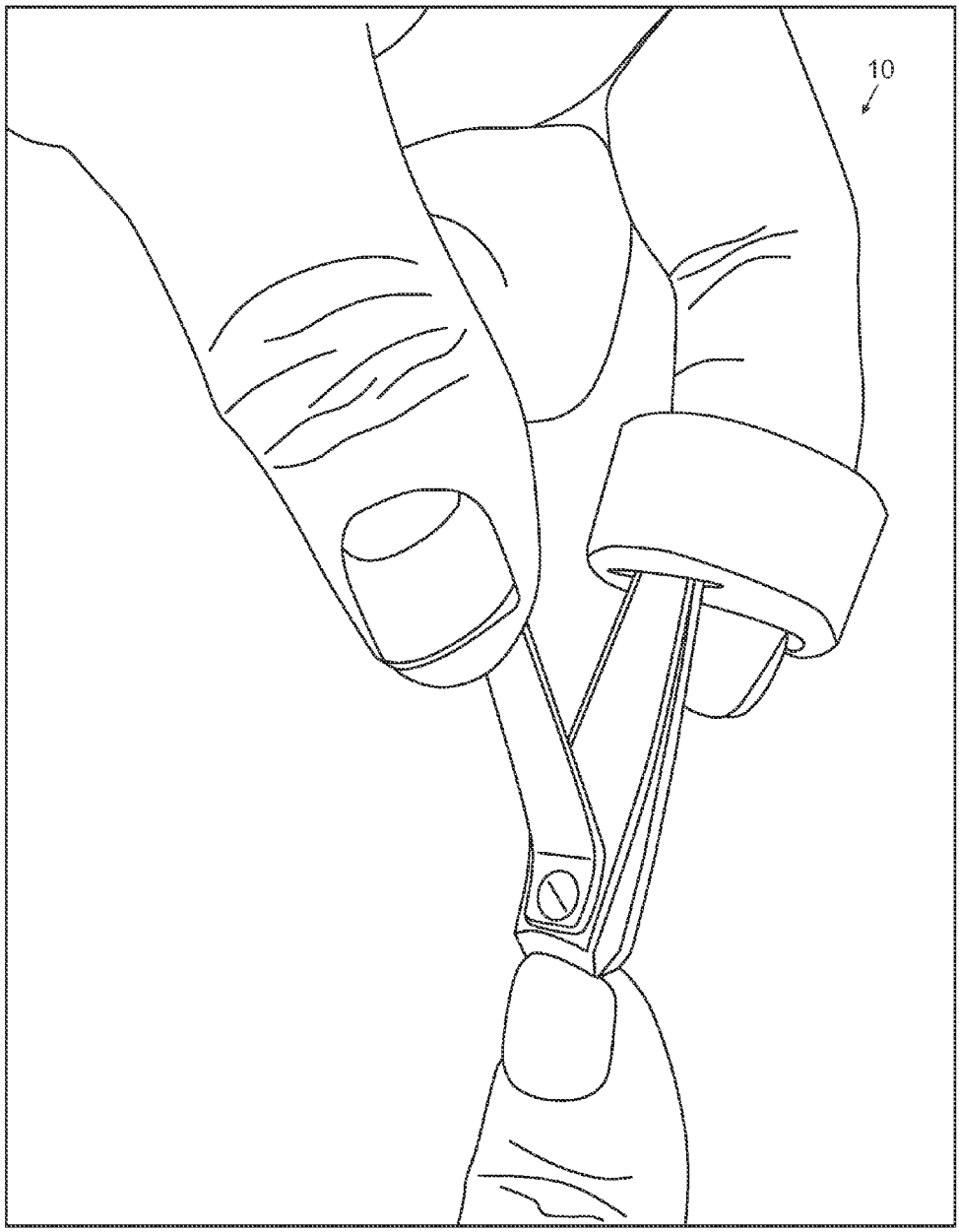
FIG. 3 is generally an illustration of a preferred embodiment in accordance with the current invention with an end portion of a clipper in a slit and an index finger in a ring aperture.
Figure 4:
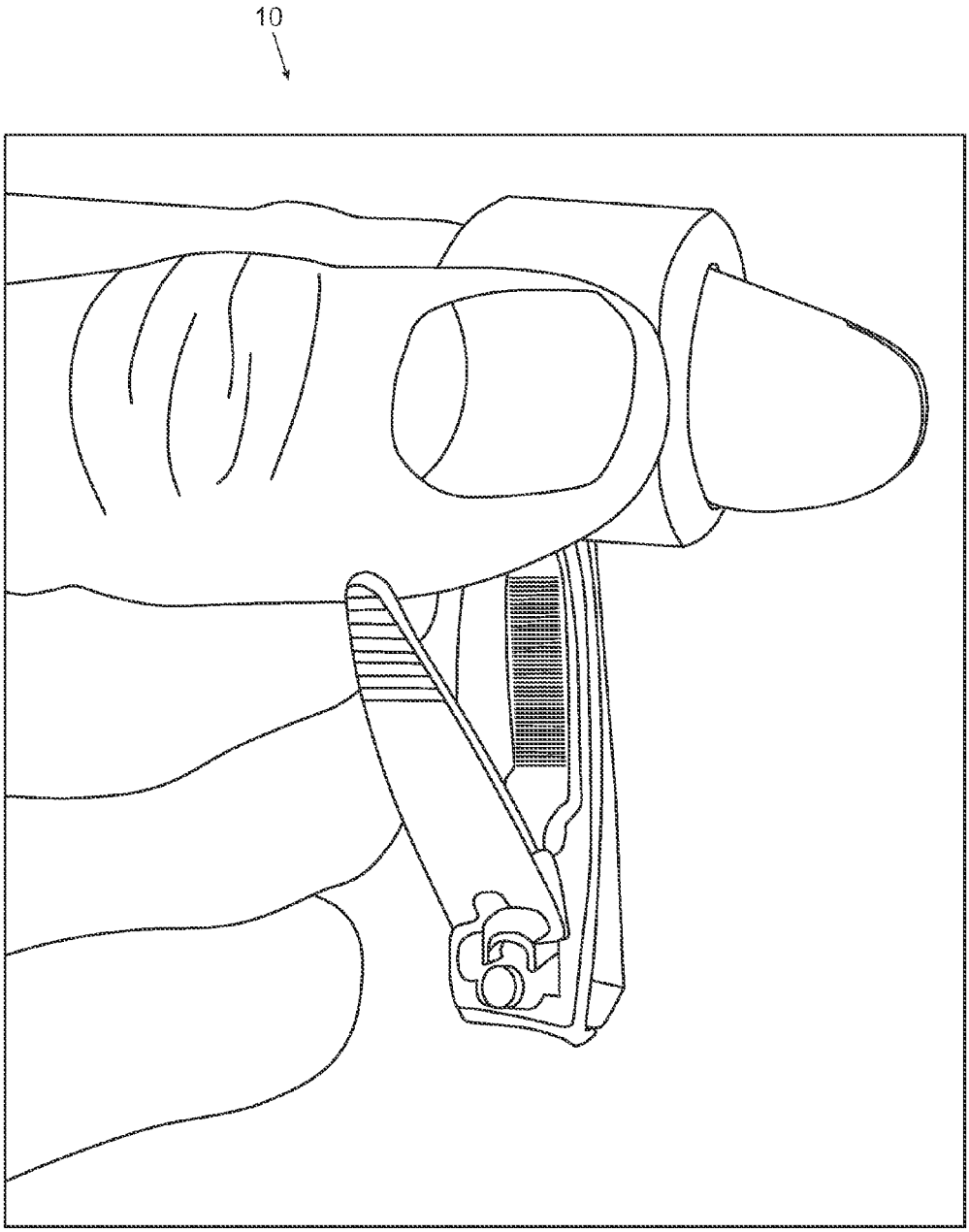
FIG. 4 is generally an illustration of a preferred embodiment in accordance with the current invention with an end portion of a clipper in a side slit and an index finger in a ring aperture.

Slit 30 may also receive thumb rest 200 as generally depicted in FIG. 2. It is also understood that ring 20 may have more than one slit 30 wherein slit 30 may be oriented to allow clippers 40 to generally be at right angle to finger 60 as generally depicted in FIG. 4. Numerous angles are contemplated for slit 30 as well as number of same. A preferred embodiment may include a second slit 220.

In a preferred embodiment, the axis x-x of ring 20 is essentially parallel to the plane formed by the central axis of members 70 and 80 so that the forefinger or finger 60 and thumb are generally in a pincer-like position when holding clippers 40 in operable position. By this means, clippers 40 may be pointed to a finger or toenail and used in clipping fashion while fully controlled by said finger and thumb, thereby eliminating the need to balance the clippers 40 against the finger or toe whose nail is to be clipped.

It is therefore contemplated to provide a removable ring accessory for a nail clipper comprising a first aperture adapted for removably securing to a human finger; a second aperture adapted for removably securing to said nail clipper; and wherein said ring accessory is made from an elastomeric material and said elastomeric material has a durometer of about 40.

It is also therefore contemplated to provide a nail clipper system comprising a pair of upper and lower co-extensive, yieldingly-resilient and cooperatively-opposed members having correspondingly-mated inward and outward end portions; said outward end portions of said members superimposed upon each other and fixedly joined together; said inward ends spring biased and spaced-apart in divergent relationship and including transverse confronting jaws with mating primary cutting blades of requisite curvature and clipping ability; a lever extending angularly upward from a pivotal mounting at a divergent portion of said members and including a cam-like surface for angular movement with said lever thereabout to squeeze said blades together in a clipping action when said lever is rotated toward said joined ends of said members; and an elastomeric ring having a first aperture adapted to be removably attached to said members at said joined ends and a second aperture adapted to removably hold the distal phalange of the user's index finger in fixed receipt therein to operatively support said clipper between the thumb and the end of the forefinger in a pincer-like position.

A number of implementations have been described herein. Nevertheless, it will be understood that various modifications may be made. Accordingly, other implementations are within the scope of the following claims. Changes may be made in the combinations, operations, and arrangements of the various parts, elements, and amounts described herein without departing from the spirit and scope of the invention. From the foregoing description of the preferred embodiment of the invention, it will be apparent that many modifications can be made, and it will be understood that the presently disclosed embodiment is exemplary only, and that the invention is not limited thereto.

I claim:

1. A nail clipper system comprising:

a) a pair of upper and lower co-extensive, yieldingly-resilient and cooperatively-opposed members having correspondingly-mated inward and outward end portions;

b) said outward end portions of said members superimposed upon each other and fixedly joined together;

c) said inward end portions spring biased and spaced-apart in divergent relationship and including transverse confronting jaws with mating primary cutting blades of curvature and clipping ability;

d) a lever extending angularly upward from a pivotal mounting at a divergent portion of said members and including a cam-like surface for angular movement with said lever thereabout to squeeze said blades together in a clipping action when said lever is rotated toward said joined ends of said members; and, e) an elastomeric ring having a first slit adapted to be removably attached to said members at said joined ends;

an aperture with a center axis positioned parallel to a center axis of said first slit and adapted to removably hold a distal phalange of a user's index finger in fixed receipt therein; and a second slit adapted to be removably attached to said members at said joined ends wherein said second slit has a center axis positioned perpendicular to said center axis of said aperture.

* * * * *